US008430745B2

(12) United States Patent
Agarwal et al.

(10) Patent No.: US 8,430,745 B2
(45) Date of Patent: Apr. 30, 2013

(54) MOBILE-PHONE-BASED WAGERING GAME ACCOUNT TRANSACTIONS

(75) Inventors: Vijay K. Agarwal, Hoffman Estates, IL (US); Dale R. Buchholz, Palatine, IL (US); Mark C. Pace, Palatine, IL (US)

(73) Assignee: WMS Gaming, Inc., Waukegan, IL (US)

( * ) Notice: Subject to any disclaimer, the term of this patent is extended or adjusted under 35 U.S.C. 154(b) by 0 days.

(21) Appl. No.: 13/057,301

(22) PCT Filed: Aug. 4, 2009

(86) PCT No.: PCT/US2009/052771

§ 371 (c)(1),
(2), (4) Date: Feb. 3, 2011

(87) PCT Pub. No.: WO2010/017252

PCT Pub. Date: Feb. 11, 2010

(65) Prior Publication Data

US 2011/0263318 A1 Oct. 27, 2011

Related U.S. Application Data

(60) Provisional application No. 61/086,205, filed on Aug. 5, 2008.

(51) Int. Cl.
*A63F 9/24* (2006.01)

(52) U.S. Cl.
USPC ..... 463/25; 463/42

(58) Field of Classification Search ..... 463/25
See application file for complete search history.

(56) References Cited

U.S. PATENT DOCUMENTS

| | | | | |
|---|---|---|---|---|
| 6,010,067 | A | 1/2000 | Elbaum | |
| 2003/0003996 | A1 * | 1/2003 | Nguyen et al. | 463/42 |
| 2004/0147309 | A1 | 7/2004 | Chamberlain et al. | |
| 2005/0228750 | A1 | 10/2005 | Olliphant et al. | |
| 2006/0098678 | A1 * | 5/2006 | Tan | 370/441 |
| 2007/0203836 | A1 * | 8/2007 | Dodin | 705/44 |

FOREIGN PATENT DOCUMENTS

| | | |
|---|---|---|
| GB | 2475643 | 5/2011 |
| WO | WO2010017252 | 2/2010 |

OTHER PUBLICATIONS

"PCT Application No. PCT/US09/52771 International Preliminary Report on Patentability", Dec. 16, 2010, 8 pages.
"PCT Application No. PCT/US09/52771 International Search Report", Sep. 28, 2009, 8 pages.
"UK Application No. 1103433.7 Examination Report", Mar. 5, 2012, 1 page.
"UK Application No. 1103433.7 Examination Report", Feb. 7, 2013, 4 pages.

(Continued)

*Primary Examiner* — Omkar Deodhar
(74) *Attorney, Agent, or Firm* — DeLizio Gilliam, PLLC

(57) ABSTRACT

In some embodiments a method includes receiving, from a mobile phone, a request to transfer a first fund amount from a player account to a wagering game machine. The method can also include determining that the player account does not include the first fund amount; receiving a second fund amount from a secondary funding source, and augmenting the player account by the second fund amount, wherein the augmenting results in the player account including the first fund amount. The method can also include transferring the first fund amount from the player account to the wagering game machine; debiting the player account by the first fund amount.

18 Claims, 9 Drawing Sheets

OTHER PUBLICATIONS
"UK Application No. 1103433.7 Examination Report", Jan. 8, 2013, 2 pages.
"UK Application No. 1103433.7 Examination Report", Jan. 25, 2013, 5 pages.
"UK Application No. 1301971.6 Examination Report", Feb. 20, 2013, 7 pages.

* cited by examiner

MOBILE-PHONE-BASED WAGERING GAME ACCOUNT TRANSACTIONS

RELATED APPLICATIONS

This application claims the priority benefit of U.S. Provisional Application Ser. No. 61/086,205 filed Aug. 5, 2008.

LIMITED COPYRIGHT WAIVER

A portion of the disclosure of this patent document contains material which is subject to copyright protection. The copyright owner has no objection to the facsimile reproduction by anyone of the patent disclosure, as it appears in the Patent and Trademark Office patent files or records, but otherwise reserves all copyright rights whatsoever. Copyright 2009, WMS Gaming, Inc.

FIELD

Embodiments of the inventive subject matter relate generally to wagering game systems, and more particularly to player account transactions in wagering game systems.

BACKGROUND

Wagering game machines, such as slot machines, video poker machines and the like, have been a cornerstone of the gaming industry for several years. Generally, the popularity of such machines depends on the likelihood (or perceived likelihood) of winning money at the machine and the intrinsic entertainment value of the machine relative to other available gaming options. Where the available gaming options include a number of competing wagering game machines and the expectation of winning at each machine is roughly the same (or believed to be the same), players are likely to be attracted to machines that are most entertaining, exciting, and easy to use. Shrewd operators consequently strive to employ the most entertaining and exciting machines, features, and enhancements available because such machines attract frequent play and hence increase profitability to the operator. Therefore, there is a continuing need for wagering game machine manufacturers to continuously develop new games and gaming enhancements that will attract frequent play. Players may be drawn to systems that offer new and convenient ways for funding wagering games.

SUMMARY

In some embodiments, a method comprises receiving, from a mobile phone, a request to transfer a first fund amount from a player account to a wagering game machine; determining that the player account does not include the first fund amount; receiving a second fund amount from a secondary funding source; augmenting the player account by the second fund amount, wherein the augmenting results in the player account including the first fund amount; transferring the first fund amount from the player account to the wagering game machine; debiting the player account by the first fund amount.

In some embodiments, the transferring occurs before a player associated with the player account has signed-onto the wagering game machine.

In some embodiments, the method further comprises receiving, from the mobile phone, a third fund amount; and crediting the player account by the third fund amount.

In some embodiments, the request to transfer the first fund amount is included in a short message service (SMS) message.

In some embodiments, the player account indicates the secondary funding source.

In some embodiments, the secondary funding source is a financial institution server operated by bank.

In some embodiments, a wagering game account server comprises a player account base configured to store a plurality of player accounts, the player accounts including funds; a request processor electronically coupled to the player account base, the request processor configured to receive a request to electronically transfer funds from one of the player accounts to a wagering game machine, the request originating at a mobile phone, and the funds being for use in playing wagering games on the wagering game machines; and a transaction processor electronically coupled to the player account base and the request processor, the transaction processor configured to electronically transmit the funds to the wagering game machine and update the player account base to indicate a debit on the one of the player accounts.

In some embodiments, the request to electronically transfer funds is included in a short message service (SMS) message.

In some embodiments, the request processor is further configured to receive a request to electronically transfer funds from the mobile phone into the one of the player accounts; the transaction processor is further configured to update the player account base to indicate a credit based on the transfer of funds from the mobile phone.

In some embodiments, the transaction processor is further configured to determine that the one player accounts does not include the funds and to procure the funds from a secondary funding source.

In some embodiments, the request to electronically transfer funds is included in a message in a protocol that is not native to the mobile phone.

In some embodiments, a mobile phone capable of transferring funds to devices on a wagering game network, the mobile phone comprises an account interface controller configured to present a user interface elements associated with requesting transfer of funds from a player account to a wagering game machine, wherein mobile phone does not include the player account, and wherein the funds are for use in playing wagering games on the wagering game machine; a transaction controller electronically coupled to the account interface controller, wherein the transaction controller is configured to transmit a request to transfer the funds on the player account to the wagering game machine.

In some embodiments, the mobile phone further comprises a vault configured to electronically store the funds received from the wagering game machine, wherein the transaction controller is further configured to store the funds from the wagering game machine in the vault.

In some embodiments, the transaction controller is further configured to transfer the funds stored in the vault to the player account.

In some embodiments, the request to transfer the funds on the player account to the wagering game machine is included in a short message service (SMS) message.

In some embodiments, the request to transfer the funds on the player account to the wagering game machine is transmitted directly to the wagering game machine.

In some embodiments, a wagering game network comprises a mobile phone configured to transmit a request to electronically transfer a first monetary amount from a player account to a wagering game machine; a wagering game account server configured to receive the request, to transmit the first monetary amount to the wagering game machine, and to update the player account to indicate the transfer; and the wagering game machine configured to electronically receive the first monetary amount, to make the monetary amount available of use in wagering games, and to present the wagering games.

In some embodiments, the wagering game machine is further configured to electronically transfer a second monetary amount to the mobile phone, and wherein the mobile phone is further configured to electronically transfer the second monetary amount to the player account in the wagering game account server.

In some embodiments, the request is included in a short message service (SMS) message.

In some embodiments, the wagering game account server is further configured to determine that the player account does not include the first monetary amount and to electronically procure a second monetary amount from a secondary funding source.

In some embodiments, the wagering game machine configured to electronically receive the first monetary amount after a player associated with the player account has signed-on.

In some embodiments, the wagering game machine configured to electronically receive the first monetary amount before a player associated with the player account has signed-on.

In some embodiments, a wagering game account server comprises means for receiving, from a mobile phone, a request to transfer funds from a financial institution account to a casino account, wherein the casino account is associated with a player; means for requesting and receiving the funds from the financial institution account; means for delivering the funds into the casino account; means for transferring at least some of the funds into a game session account available on one or more wagering game machines, wherein the game session account provides the funds for use in wagering games; and means for notifying the mobile phone about one or more account transactions.

In some embodiments, the transferring occurs before a player associated with the player account has signed-onto the wagering game machine.

In some embodiments, the wagering game account server further comprises means for transferring at least some of the funds from the casino account to the mobile phone.

BRIEF DESCRIPTION OF THE FIGURES

The present invention is illustrated by way of example and not limitation in the Figures of the accompanying drawings in which.

DESCRIPTION OF THE EMBODIMENTS

This description of the embodiments is divided into five sections. The first section provides an introduction to embodiments of the invention, while the second section describes wagering game networks and their components. The third section describes operations performed by some embodiments, and the fourth section describes example wagering game machines in more detail. The fifth section presents some general comments.

Introduction

This section provides an introduction to some embodiments of the invention.

Wagering game systems typically offer a limited number of ways by which players can provide monetary value for use in wagering games. Some wagering game machines enable players to fund wagering games by inserting cash or cashless vouchers. However, many players find carrying cash or vouchers to be cumbersome. As an alternative, some wagering game systems allow players to fund wagering games by transferring money from casino player accounts. Such systems typically require players to be present at the machine and to navigate account menus before delivering funds. Furthermore, as players' casino accounts become depleted, players often have to leave the casino floor to deposit additional funds into the casino accounts.

Figure 1:
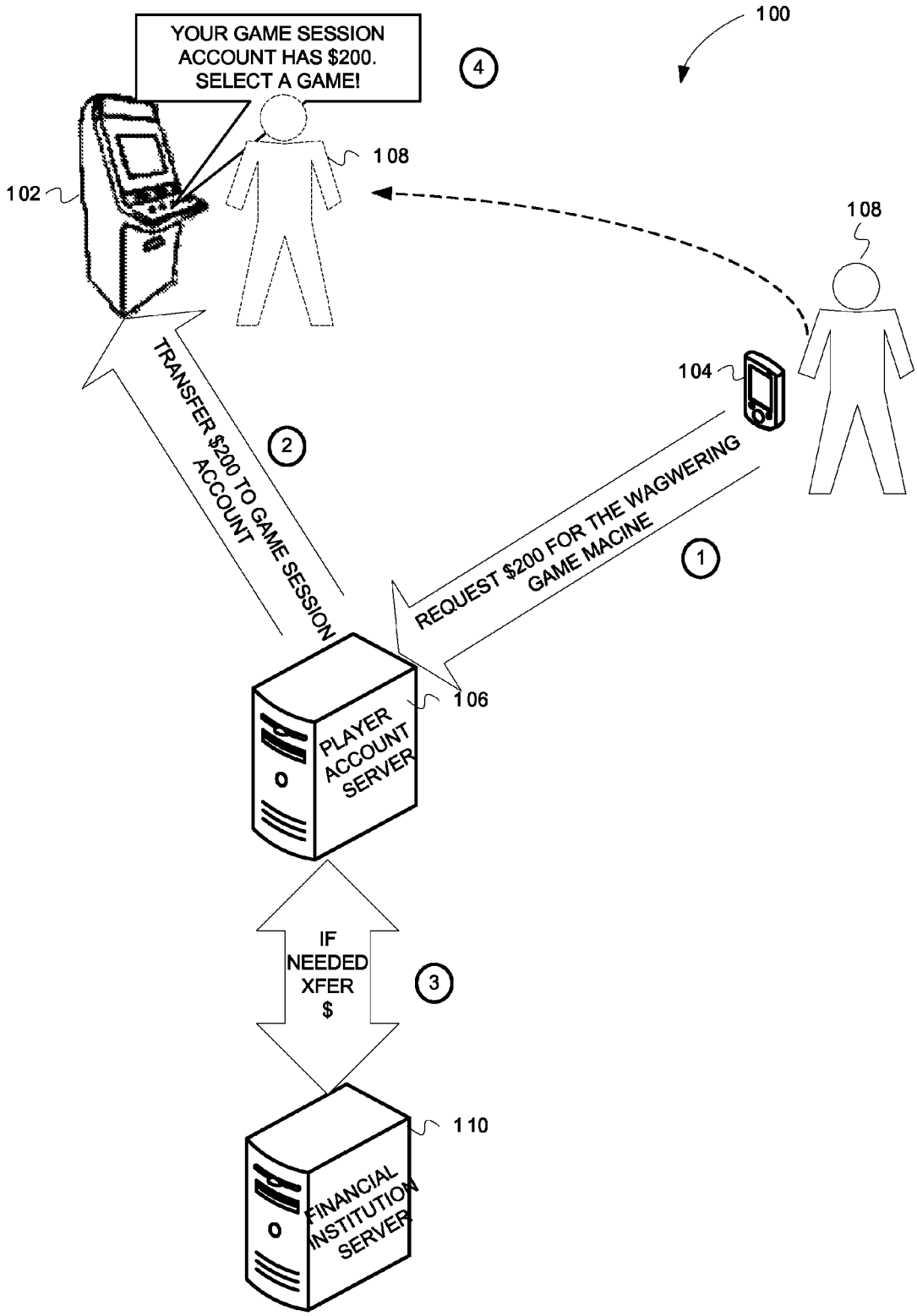
FIG. 1 is a dataflow diagram showing how players can transfer funds to wagering game machines using mobile telephones, according to some embodiments of the invention.

Some embodiments of the inventive subject matter enable players to easily and securely make funds available for wagering games. In particular, some embodiments allow players to use mobile telephones for transferring funds between financial institution accounts, casino accounts, and game session accounts. Additionally, some embodiments allow mobile phones to store funds for later use in wagering games. Because players can transfer funds using mobile phones, some embodiments can facilitate funds transfers before players are physically present at wagering game machines. FIG. 1 helps illustrate this concept.

FIG. 1 is a dataflow diagram showing how players can use mobile phones for transferring funds for use in wagering games, according to some embodiments of the invention. As shown, a wagering game machine 102, player account server 106, financial institution server 110, and mobile telephone 104 can operate together to facilitate mobile-phone-based player account transactions. The operations and data flow occur in four stages.

During stage one, a player 108 can use the mobile phone 104 to request that $200 be transferred from the player's casino account to a game session account that is available to the wagering game machine 102. The mobile phone 104 transmits the request to the player account server 106, which manages the player's account. In some instances, the player 108 sends the funds transfer request before being physically present at the wagering game machine 102 (e.g., from the casino lobby). During stage two, if the player's account is lacking sufficient funds, the player account server 108 acquires the necessary funds from the financial institution server 108. The player's account can designate a secondary funding source, such as a bank account residing on the financial institution server 110.

During stage three, the player account server 106 transfers $200 to a game session account residing on the wagering game machine 102. Thus, after stage three, the game session account includes $200 for playing wagering games on the machine 102. In some instances, the server 106 may not actually transfer the $200, but instead notify the machine 102 that $200 is available for wagering. During stage four, the player initiates a wagering game session and the wagering game machine 102 makes the $200 available to the player.

In some embodiments, the system 100 enables players to use mobile phones for performing other account operations, such as transferring funds between financial institution accounts and casino accounts, and between casino accounts and game session accounts. The following sections describe many other embodiments and features.

Example Operating Environment

This section describes an example operating environment and provides structural aspects of some embodiments. This section includes discussion about wagering game networks their various components.

Wagering Game Network

Figure 2:
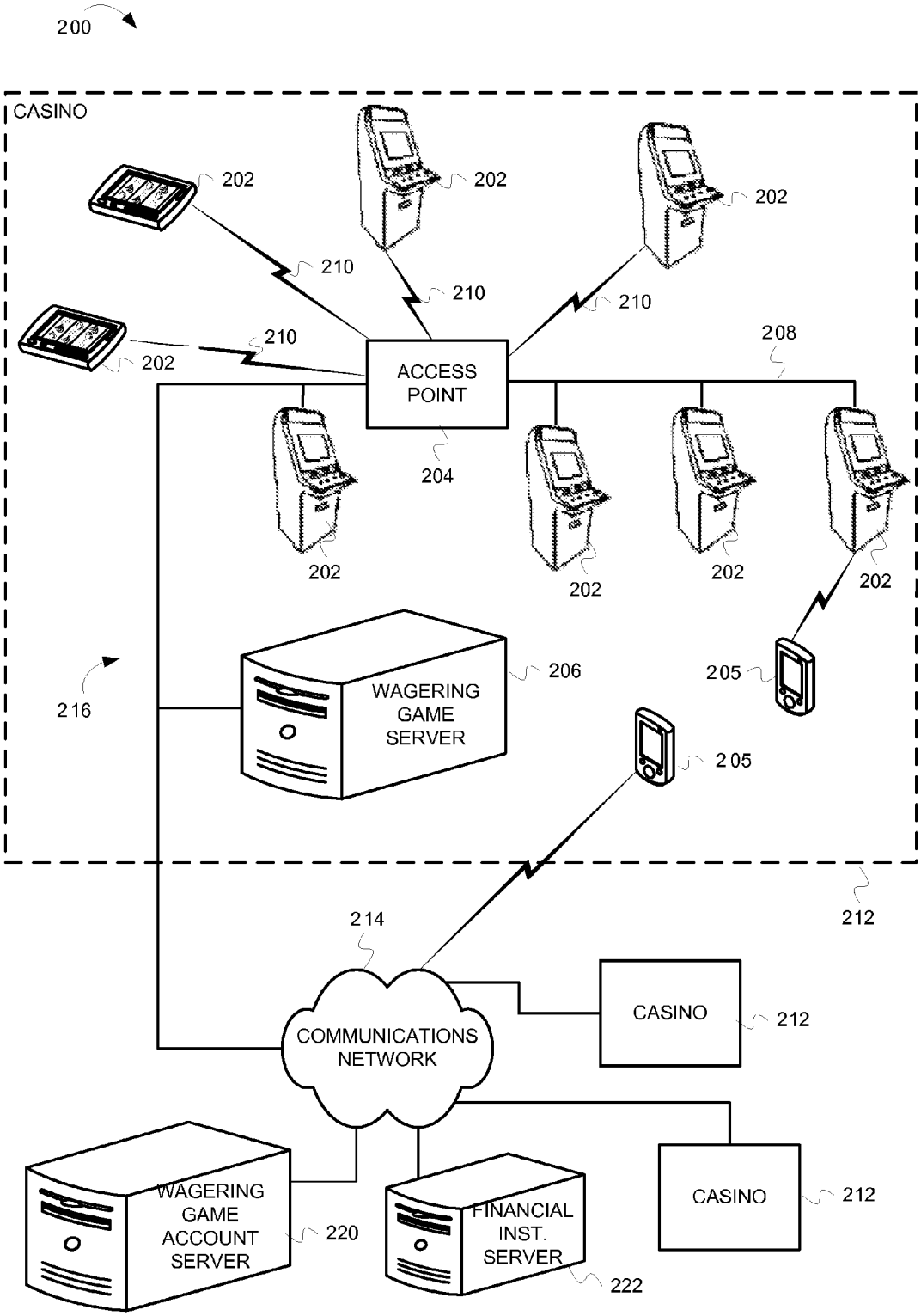
FIG. 2 is a block diagram illustrating a wagering game network 200, according to example embodiments of the invention.

FIG. 2 is a block diagram illustrating a wagering game network 200, according to example embodiments of the invention. As shown in FIG. 2, the wagering game network 200 includes a communications network 214 connected to a wagering game account server 220, financial institution server 222, and a plurality of casinos 212. The communications network 214 can include components for transmitting data between casinos 212. In some embodiments, the communications network 214 can include public switch telephone networks, cellular telephone networks, digital cable networks, etc.

The wagering game account server 220 can manage financial transactions associated with player accounts. The server 220 can communicate with other network components, such as the financial institution server 222, when transferring funds and processing player account transactions. In some embodiments, the wagering game account server 220 is located inside a casino 212.

The financial institution server 222 can receive transaction requests from components of the wagering game network 200 (e.g., wagering game account server 220, wagering game machines 202, etc.). In response, the financial institution server 222 can provide funds, account information, or other data.

Each of the plurality of casinos 212 includes a local area network 216, which may include an access point 204, mobile phones 205, wagering game server 206, and wagering game machines 202. The access point 204 provides wireless communication links 210 and wired communication links 208. The wired and wireless communication links can employ any suitable connection technology, such as Bluetooth, Wi-Fi, Ethernet, SONET, USB, arcnet, current loop, etc.

The mobile phones 205 can transmit player account transaction requests (e.g., funds transfer requests) to components of the wagering game network 200. For example, the mobile phones 205 transmit account requests directly to network components using Bluetooth. The mobile phones 205 can also transmit account requests using cellular networks or via the access point 204. In some embodiments, the mobile phones 205 do not include any special software to facilitate player account transactions. That is, the mobile phones 205 can request account transactions using native functionality, such as SMS messaging, voice calling, data calling, etc. However, the mobile phones 205 can include clients (e.g., software) that support player account transactions and protocols for interacting with wagering game machines 202, wagering game account servers 220, etc. In some instances, other mobile devices are used instead of mobile phones. For example, some embodiments include personal digital assistants, pagers, laptop computers, handheld computers, etc. The devices may communicate using any suitable data format, such as voice, voice chat, text message (e.g., SMS), text chat, etc.

The wagering game server 206 can serve wagering games and/or distribute content to wagering game machines 202 and other devices on the local area network 216, in other casinos 212, or at other locations on the communications network 214.

In some instances, the wagering game server 206 provides a chat facility though which players can chat (e.g., text, voice, video, etc.) with each other or social contacts who are online outside the casino. In some instances, the server 206 can monitor the chat and offer promotions based on chat content. For example, if a player were to send a text chat message that said, "I am hungry," the server 206 can present promotional content (e.g., banner advertisement) for restaurants in the casino. In some instances, the server 206 may take reservations or other information associated with promotions presented in response to chat content. Some of the promotions can be targeted based on the player's profile information, while other promotions can be based on avaible resources (e.g., a restaurant that has tables available for dinner).

The wagering game machines 202 present wagering games. Furthermore, the wagering game machines 202 can include logic for transmitting and receiving information associated with player account transactions. For example, the machines 202 can include one or more wireless transceivers capable of transmitting and receiving information according to any suitable protocol (e.g., Wi-Fi, Bluetooth, infrared, etc.). Additionally, the machines 202 can include logic for processing funds transfers and other player account transactions.

In various embodiments, wagering game machines 202 and wagering game servers 206 work together such that a wagering game machine 202 may be operated as a thin, thick, or intermediate client. For example, one or more elements of game play may be controlled by the wagering game machine 202 (client) or the wagering game server 206 (server). Game play elements may include executable game code, lookup tables, configuration files, game outcome, audio or visual representations of the game, game assets or the like. In a thin-client example, the wagering game server 206 may perform functions such as determining game outcome or managing assets, while the wagering game machine 202 may be used merely to present the graphical representation of such outcome or asset modification to the user (e.g., player). In a thick-client example, game outcome may be determined locally (e.g., at the wagering game machine 202) and then communicated to the wagering game server 206 for recording or managing a player's account.

Similarly, functionality not directly related to game play may be controlled by the wagering game machine 202 (client)

or the wagering game server 206 (server) in embodiments. For example, account transactions and account rules may be managed centrally (e.g., by the wagering game server 206) or locally (e.g., by the wagering game machine 202). Other functionality not directly related to game play may include power management, presentation of advertising, software or firmware updates, system quality or security checks, etc.

Any of the wagering game network components (e.g., the wagering game machines 202) can include hardware and machine-readable media including instructions for performing the operations described herein. Machine-readable media includes any mechanism that provides (i.e., stores and/or transmits) information in a form readable by a machine (e.g., a wagering game machine, computer, etc.). For example, tangible machine-readable media includes read only memory (ROM), random access memory (RAM), magnetic disk storage media, optical storage media, flash memory machines, etc. Machine-readable media also includes any media suitable for transmitting software over a network.

Component Architectures

Figure 3:
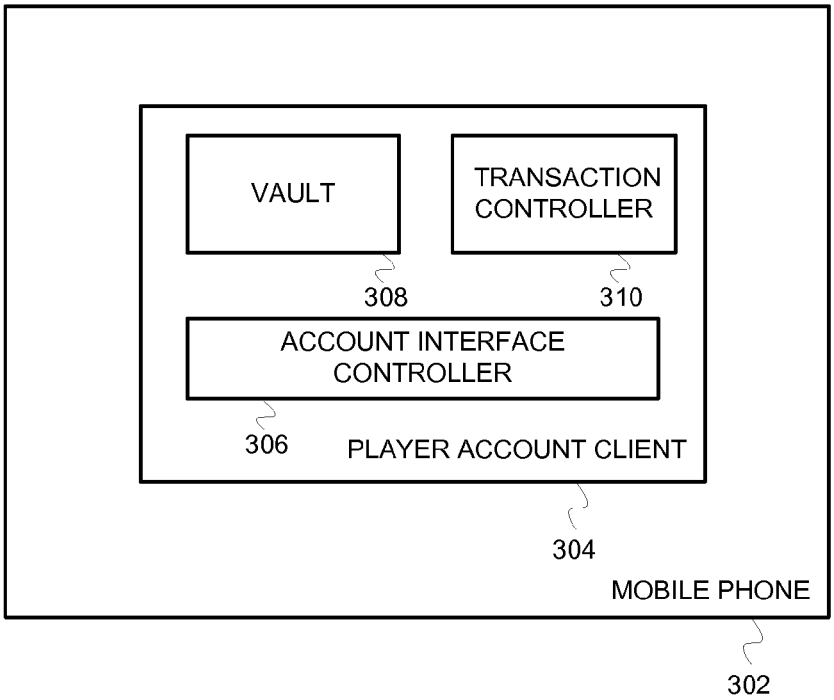
FIG. 3 is a block diagram illustrating a mobile phone including a player account client, according to some embodiments of the invention.
Figure 4:
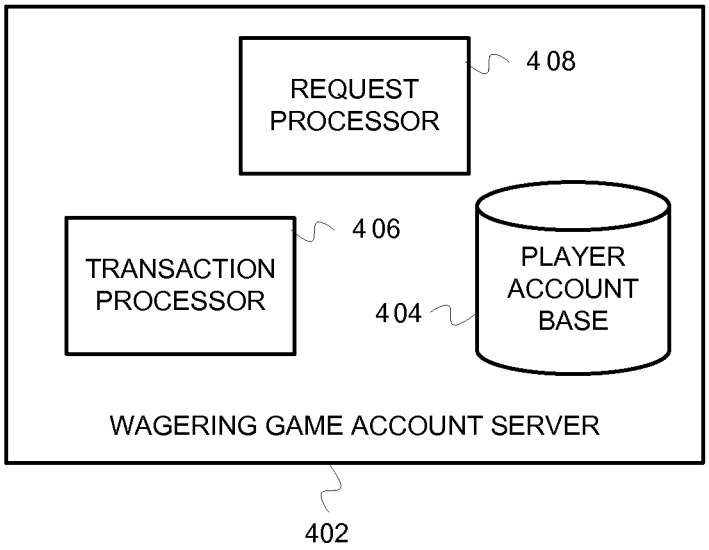
FIG. 4 is a block diagram illustrating a wagering game account server, according to some embodiments of the invention.
Figure 5:
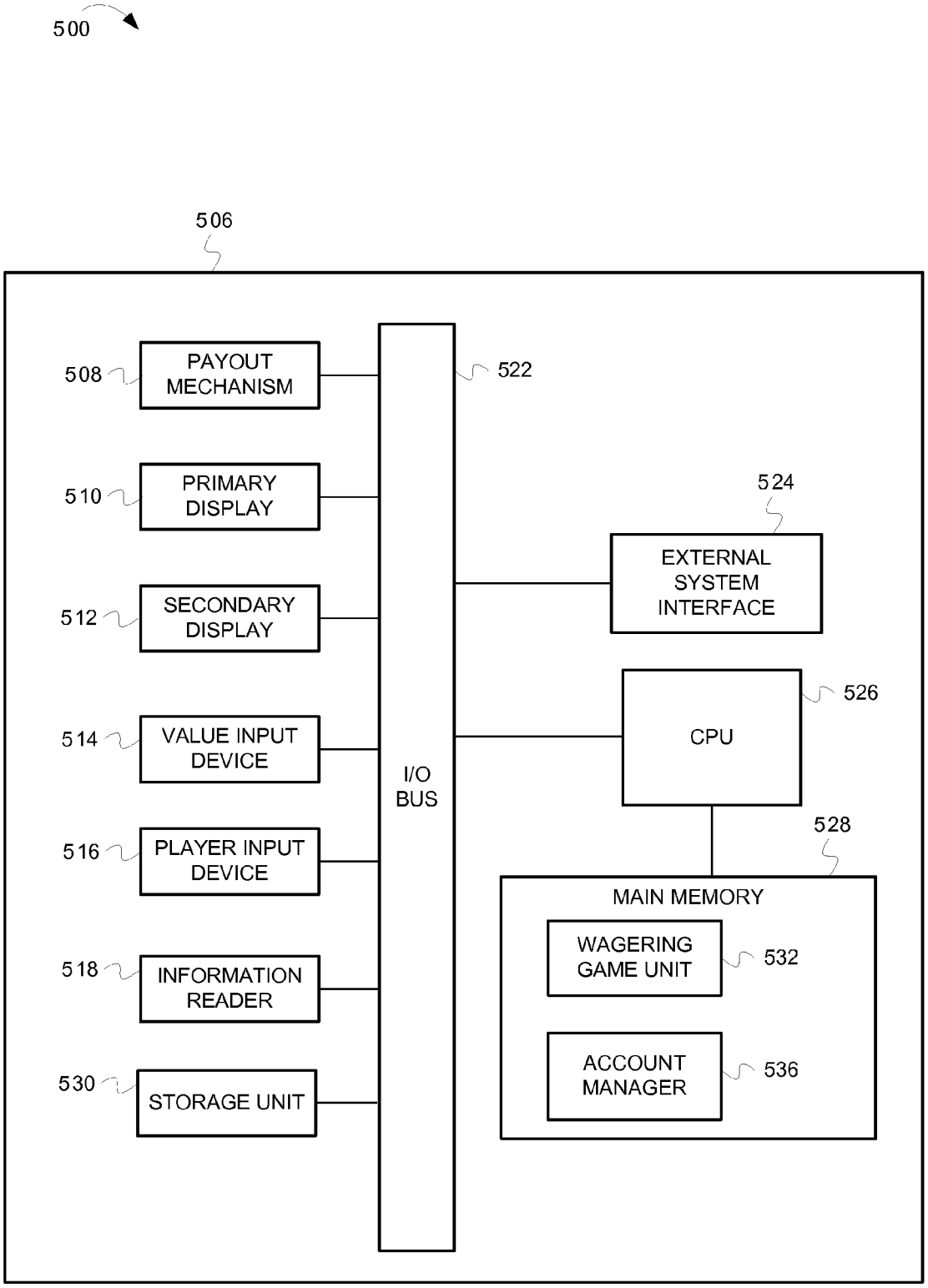
FIG. 5 is a block diagram illustrating a wagering game machine, according to example embodiments of the invention.

The discussion continues with a more detailed description of wagering game network components. FIGS. 3-5 describe mobile phones, wagering game account servers, and wagering game machines in more detail.

FIG. 3 is a block diagram illustrating a mobile phone including a player account client, according to some embodiments of the invention. As shown, a player account client 304 can include a player interface controller 306, transaction controller 310, and vault 308. The account interface controller 306 can present graphical user interfaces through which players can enter information about wagering game account transactions. In some instances, the controller 306 presents interfaces tailored to particular player account transactions, such as interfaces for transferring funds from a player account to a wagering game machine's game session account. The interfaces can include drag-and-drop icons that allow the player to drag various monetary denominations to particular wagering game machines located on a casino floor map. In some embodiments, the account interface controller 306 can present different casino floor maps based on the cell phone's geographic position (e.g., using a global positioning system receiver in the phone 302). The controller 306 can also facilitate other input/output, such as presentation of player account balances, recent transactions, etc.

The transaction controller 310 can process player input received through the account interface controller 306. In some embodiments, the transaction controller 310 processes transaction requests and communicates with wagering game account servers, financial institution servers, or other wagering game network components. For example, if a player requests a funds transfer from a casino account to a game session account, the transaction controller 310 can transmit the request to a wagering game account server or other network component.

In some instances, the transaction controller 310 receives funds from a wagering game machine (or other device maintaining a player's game session account) and stores the funds in the vault 308. The vault 308 represents logic (e.g., instructions, media, circuitry, etc.) for tracking and storing funds that can be transferred from/to game session accounts residing on wagering game machines or other components. For example, when a player "cashes-out" on a wagering game machine, the wagering game machine can transfer its game session account balance to the transaction controller 310 for storage in the vault 308. Operations for cashing-out to a vault are described in more detail below (see FIG. 8).

Although not shown in FIG. 3, the mobile phone 302 can include other components. For example, in some embodiments the mobile phone 302 can include memory and a processor for storing and executing the client 304. Additionally, the mobile phone 304 can include various wireless transceivers, such as WiFi transceivers, Bluetooth transceivers, infrared transceivers, cellular-technology transceivers (e.g., GSM, CDMA and TDMA transceivers), etc.

FIG. 4 is a block diagram illustrating a wagering game account server, according to some embodiments of the invention. As shown, a wagering game account server 402 can include a request processor 408, transaction processor 406, and player account base 404. The request processor 408 can receive transaction requests from wagering game network components, such as mobile phones, wagering game machines, kiosks (not shown), etc. The transaction requests can include funds transfer requests, balance inquiries, deposits, etc.

The transaction processor 406 can process the transaction requests and carry out the requested transactions. For example, the transaction processor 406 can transfer monies between financial institution accounts and casino accounts, and between casino accounts and game session accounts. Funding game session accounts may entail transferring funds to wagering game machines or notifying machines that certain funds are available. In some instances, the transaction processor 406 completes funds transfers before players are physically present at the wagering game machines (e.g., in response to account requests originating from mobile phones). In some instances, the transaction processor 406 can communicate with financial institution servers (e.g., bank computers configured to perform bank account transactions for the bank's customers). For example, in response to a mobile phone's transfer request, the transaction processor 406 can procure funds from a financial institution server.

The player account base 404 stores account information for the player accounts. For example, the player account base 404 can include information about secondary funding sources from which to draw when wagering game accounts are depleted. The player account base 404 can also stores transaction records (e.g., debits, credits, etc.) for each player account. Thus, as the transaction processor 406 processes player account transactions, it records information in the player account base 404. For example, when the transaction processor 406 transfers funds from a player account to a wagering game machine, the processor 406 stores a transaction record associated with the player account.

FIG. 5 is a block diagram illustrating a wagering game machine, according to example embodiments of the invention. As shown in FIG. 5, a wagering game machine 506 includes a central processing unit (CPU) 526 connected to main memory 528. The CPU 526 can include any suitable processor, such as an Intel® Pentium III processor, Intel® Core 2 Duo processor, AMD Opteron™ processor, UltraSPARC processor, etc. The main memory 528 includes a wagering game unit 532 and an account manager 536. In some embodiments, the wagering game unit 532 can present wagering games, such as video poker, video black jack, video slots, video lottery, etc., in whole or part.

The account manager 536 can process player account transactions. For example, the account manager 536 can electronically receive funds from players' casino accounts or other sources. In turn, the account manager 536 makes the funds available for use in wagering games. If a player is signed-into the machine 506, the account manager 536 can immediately make the funds available to the player. However, if the account manager 536 receives funds before a player has signed-into the machine 506, the manager 536 can store the funds until the player signs-in. In some embodiments, the account manager 536 can transfer funds to mobile phones, player accounts, bank accounts, etc.

The CPU 526 is also connected to an input/output (I/O) bus 522, which can include any suitable bus technologies, such as an AGTL+ frontside bus and a PCI backside bus. The I/O bus 522 is connected to a payout mechanism 508, primary display 510, secondary display 512, value input device 514, player input device 516, information reader 518, and storage unit 530. The player input device 516 can include the value input device 514 to the extent the player input device 516 is used to place wagers.

The I/O bus 522 is also connected to an external system interface 524, which can connect to external components, such as components on a wagering game network. The external system interface 524 can include one or more transceivers for sending and receiving data according to any suitable transmission protocol, such as Wi-Fi, Ethernet, Bluetooth, infrared, etc.

In one embodiment, the wagering game machine 506 can include additional peripheral devices and/or more than one of each component shown in FIG. 5. For example, in one embodiment, the wagering game machine 506 can include multiple external system interfaces 524 and/or multiple CPUs 526. In one embodiment, any of the components can be integrated or subdivided.

Communication & Operations

Figure 7:
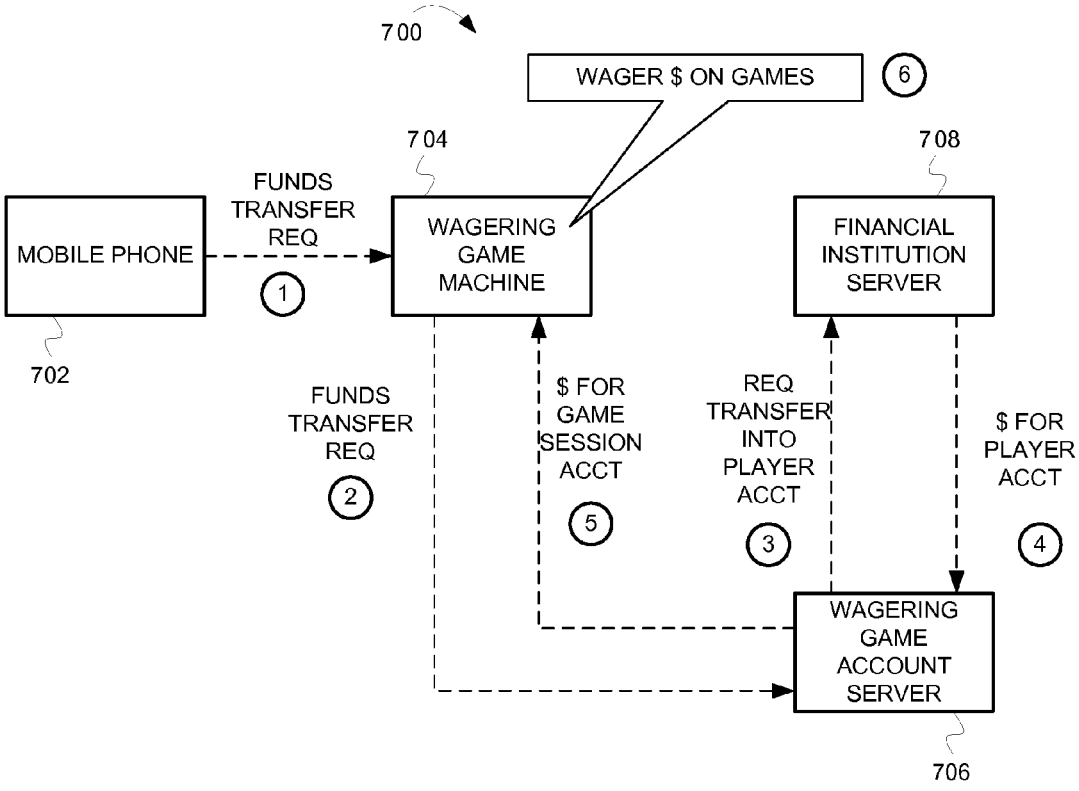
FIG. 7 is a dataflow diagram illustrating operations and communications associated with account transactions in a wagering game network, according to some embodiments of the invention.
Figure 8:
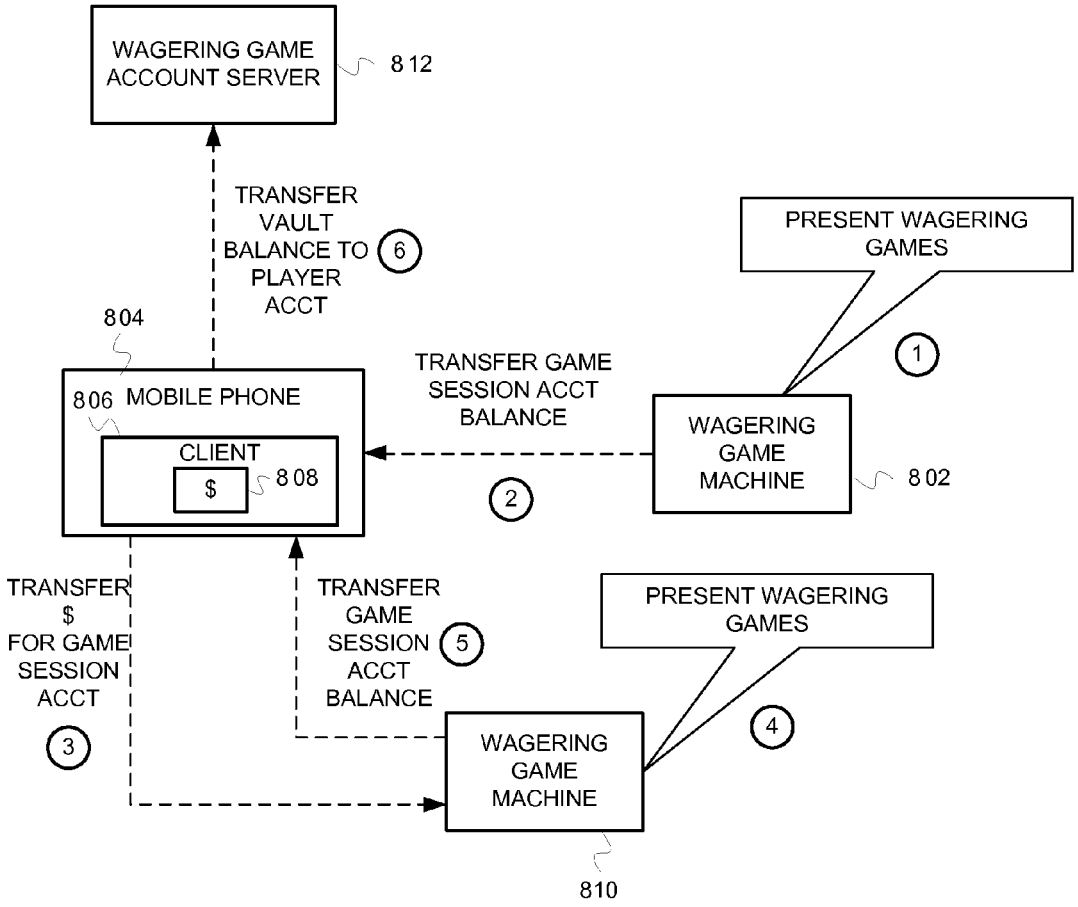
FIG. 8 is a dataflow diagram describing operations and communications for transferring funds to a mobile phone, according to some embodiments of the invention.

This section describes communications and operations of components in a wagering game network. In particular, FIG. 6 describes ways in which mobile phones can communicate with components in a wagering game network. FIGS. 7-8 describe communications and operations for transferring funds using a mobile phone.

Figure 6:
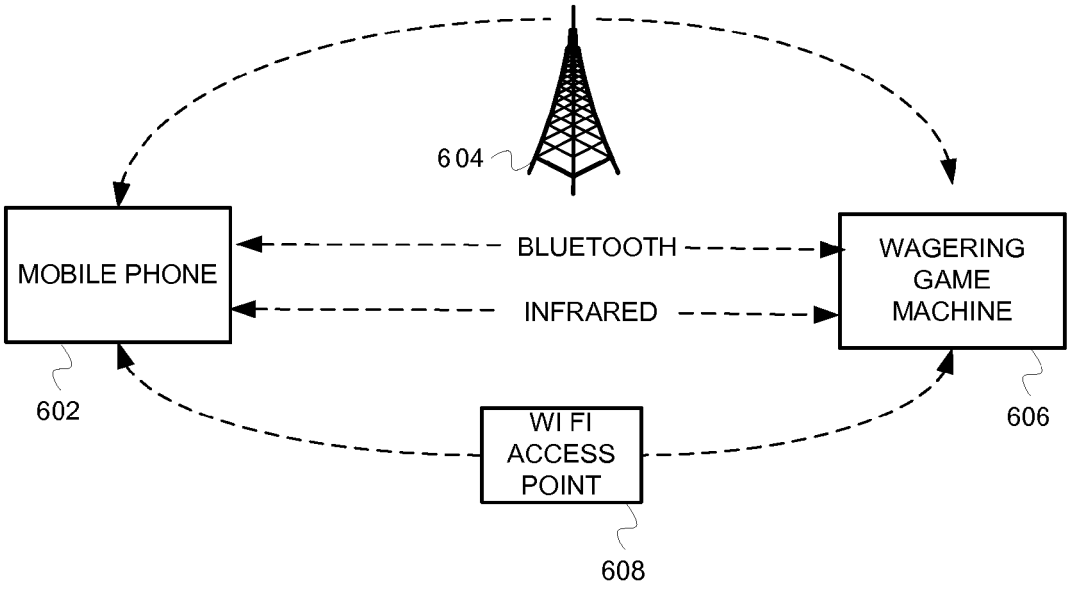
FIG. 6 is a block diagram showing communications between a mobile phone and other components of a wagering game network, according to some embodiments.

FIG. 6 is a block diagram showing communications between a mobile phone and other components of a wagering game network, according to some embodiments. FIG. 6 shows a mobile phone 602, cell tower 604, WiFi access point 608, and wagering game machine 606. According to some embodiments, the mobile phone 602 can employ any suitable communication protocol for communicating player account requests and other information to wagering game machines and other wagering game network components.

As shown, the mobile phone 602 can transmit account requests to the wagering game machine 606 via the cell tower 604 (e.g., using GSM, CDMA, TDMA, etc.). In some instances, the mobile phone 602 can communicate account requests directly to the wagering game machine 606 using Bluetooth, infrared, or other suitable transmission technologies. In other instances, the mobile phone 602 can communicate to the wagering game machine 606 via the WiFi access point 608. The account requests can represented in text messages (e.g., SMS messages), voice calls, or other suitable formats.

Although FIG. 6 shows embodiments in which the mobile phone 602 communicates account requests to the wagering game machine 606, the mobile phone 602 can transmit account requests to wagering game account servers or financial institution servers without first communicating with a wagering game machine. Thus, in some embodiments, the mobile phone 602 can transmit to wagering game account server or financial institution server via the cell tower 604, WiFi access point 608, or directly using Bluetooth, infrared, or other suitable protocols.

This discussion will now move to FIGS. 7 and 8, which describe operations and communications for facilitating wagering game account transaction via mobile phones.

FIG. 7 is a dataflow diagram illustrating operations and communications associated with account transactions in a wagering game network, according to some embodiments of the invention. As shown, a wagering game network 700 includes a mobile phone 702, wagering game machine 704, wagering game account server 706, and financial institution server 708. FIG. 7 shows six stages of operations and communications for transferring funds to the wagering game machine 704.

During stage one, the mobile phone 702 transmits a funds transfer request to the wagering game machine 704. The funds transfer request is associated with a player account stored on the wagering game account server 706. In some instances, the mobile phone 702 transmits the request directly to the wagering game machine 700 via Bluetooth, infrared, etc. In other instances, the phone 702 transfers request through a cell tower or access point. The wagering game machine 704 forwards the funds transfer request to the wagering game account server 706.

During stage two, the wagering game account server's request processor (not shown) receives the funds transfer request. The server's transaction processor determines whether a player account associated with the request includes enough funds to complete the transfer request (e.g., by inspecting the account balance in the player account base). If the account has insufficient funds, the wagering game account server 706 may proceed with stage three. Otherwise the server 706 can proceed to stage five, skipping stages three and four.

During stage three, the wagering game account server's request processor sends a request asking the financial institution server 708 to transfer funds into the player's casino account. During stage four, the wagering game account server receives money from the financial institution server 708 and deposits the money in the player's casino account.

During stage five, the wagering game account server 706 makes the requested funds available in a game session account residing on the wagering game machine 704. In some embodiments, the server 706 transfers the funds to the wagering game machine 704, which holds the funds until the player signs-onto the machine 704. In other embodiments, the server 706 transmits an indication that the funds are available without transferring the funds. After the player signs on, the machine 704 makes the funds available for use in a wagering game session (shown in FIG. 7 as stage six).

Although FIG. 7 shows certain operations, some embodiments do not necessarily perform all the operations for every transaction. For example, in some instances, players can use mobile phones to manage casino account balances. Managing account balances may include just moving money from a bank account to a casino account, or just moving money from a casino account to a game session account (e.g., residing on, or otherwise accessible to, a wagering game machine).

In some embodiments, after stage one, the wagering game machine 704 waits until the player signs-on before performing stage two. As a result, the wagering game machine 704 can avoid storing funds while players are not signed-on (i.e., physically present and ready to use the funds).

Although FIG. 7 shows the mobile phone 702 initially transmitting the request to the wagering game machine 704, in some embodiments, the phone 702 transmits the request directly to the wagering game account server 706. In yet other embodiments, the phone 702 can transmit the funds transfer request directly to the financial institution server 704, which can transfer the requested funds to the wagering game account server 706, as shown in FIG. 7.

As noted above, some embodiments of the mobile phone can receive and store funds. The discussion of FIG. 8 describes these embodiments in more detail.

FIG. 8 is a dataflow diagram describing operations and communications for transferring funds to a mobile phone, according to some embodiments of the invention. In FIG. 8, the operations and communications occur in six stages. During stage one, the wagering game machine 802 presents wagering games. In some instances, wagering game machine 802 received funding for the wagering games by the method described in FIG. 7. In other instances, wagering game machine 802 received funding when a player inserted a voucher or cash.

During stage two, the wagering game machine 802 ends the gaming session and transfers the game session account balance to the mobile phone 804. The mobile phone's client 806 receives the money and stores it in its vault 808. The player can use the money at other wagering game machines or transfer the money into other accounts (e.g., casino accounts, bank accounts, etc.).

During stage three, the phone 804 transfers the money from its vault 808 to a game session account residing on the wagering game machine 810. After the player has signed-on, the machine 810 makes the game session account available to the player. During stage four, the wagering game machine 810 presents wagering games in which the player wagers money from the game session account. During stage five, the wagering game machine 800 ends the gaming session and transfers the game session account balance back to the mobile phone's vault 808. During stage six, the mobile phone 804 transfers the vault's balance to the wagering game account server 812. Upon receipt, the server 812 deposits the money in a casino account associated with the player.

Although FIG. 8 shows the phone 804 performing two funds transfers to wagering game machines, the phone can perform any number transfers with any number of wagering game machines. Furthermore, the phone can transfer funds from its vault directly to bank accounts, casino accounts, or game session accounts. As described above, the phone 804 may communicate directly to the wagering game machines and other devices or it may communicate via other components (e.g., cell towers, access points, etc.).

Additional Features

In some embodiments, wagering game account servers can provide various player account information in response to mobile phone text messages. For example, a mobile phone can text the word "balance" to a wagering game account server. In some embodiments, the text message includes a phone number for the mobile phone (e.g., in a message header). In turn, the wagering game account server can use the phone number to select a player account. The server can determine the account balance and transmit a text message including the account balance back to the mobile phone. In some embodiments, the wagering game servers can update and report any account information based on text messages from mobile phones.

In some embodiments, players can indicate on which wagering game machine a game session balance should be made available at sign-on. For example, a player can use a mobile phone to transfer funds from a casino account to a game session account on the player's favorite machine. The machine may be identifiable by a unique identifier (e.g. number) or by selection through a graphical user interface. In other instances, the system can make the game session account available on any machine on which the player initiates a wagering game.

More Wagering Game Machines

Figure 9:
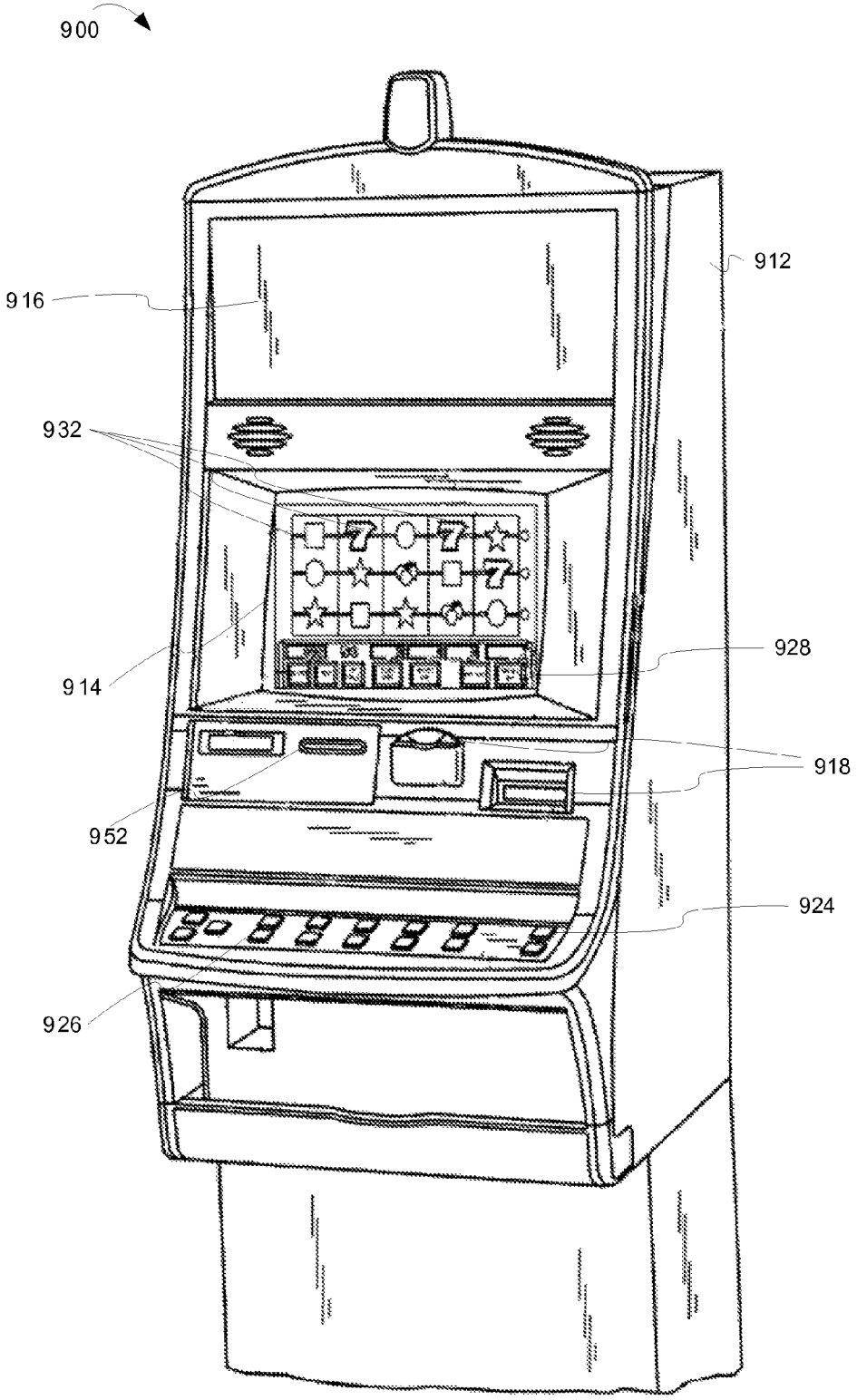
FIG. 9 is a perspective view of a wagering game machine, according to example embodiments of the invention.

FIG. 9 is a perspective view of a wagering game machine, according to example embodiments of the invention. Referring to FIG. 9, a wagering game machine 900 is used in gaming establishments, such as casinos. According to embodiments, the wagering game machine 900 can be any type of wagering game machine and can have varying structures and methods of operation. For example, the wagering game machine 900 can be an electromechanical wagering game machine configured to play mechanical slots, or it can be an electronic wagering game machine configured to play video casino games, such as blackjack, slots, keno, poker, blackjack, roulette, etc. In some embodiments, the machines described herein can take any suitable form, such as floor standing models (see FIG. 9), handheld mobile units (see FIG. 2), bartop models, workstation-type console models, etc.

The wagering game machine 900 comprises a housing 912 and includes input devices, including value input devices 918 and a player input device 924. For output, the wagering game machine 900 includes a primary display 914 for displaying information about a basic wagering game. The primary display 914 can also display information about a bonus wagering game and a progressive wagering game. The wagering game machine 900 also includes a secondary display 916 for displaying wagering game events, wagering game outcomes, and/or signage information. While some components of the wagering game machine 900 are described herein, numerous other elements can exist and can be used in any number or combination to create varying forms of the wagering game machine 900.

The value input devices 918 can take any suitable form and can be located on the front of the housing 912. The value input devices 918 can receive currency and/or credits inserted by a player. The value input devices 918 can include coin acceptors for receiving coin currency and bill acceptors for receiving paper currency. Furthermore, the value input devices 918 can include ticket readers or barcode scanners for reading information stored on vouchers, cards, or other tangible portable storage devices. The vouchers or cards can authorize access to central accounts, which can transfer money to the wagering game machine 900.

The player input device 924 comprises a plurality of push buttons on a button panel 926 for operating the wagering game machine 900. In addition, or alternatively, the player input device 924 can comprise a touch screen 928 mounted over the primary display 914 and/or secondary display 916.

The various components of the wagering game machine 900 can be connected directly to, or contained within, the housing 912. Alternatively, some of the wagering game machine's components can be located outside of the housing 912, while being communicatively coupled with the wagering game machine 900 using any suitable wired or wireless communication technology.

The operation of the basic wagering game can be displayed to the player on the primary display 914. The primary display 914 can also display a bonus game associated with the basic wagering game. The primary display 914 can include a cathode ray tube (CRT), a high resolution liquid crystal display (LCD), a plasma display, light emitting diodes (LEDs), or any other type of display suitable for use in the wagering game machine 900. Alternatively, the primary display 914 can include a number of mechanical reels to display the outcome. In FIG. 9, the wagering game machine 900 is an "upright" version in which the primary display 914 is oriented vertically relative to the player. Alternatively, the wagering game machine can be a "slant-top" version in which the primary display 914 is slanted at about a thirty-degree angle toward the player of the wagering game machine 900. In yet another embodiment, the wagering game machine 900 can exhibit any suitable form factor, such as a free standing model, bartop model, mobile handheld model, or workstation console model.

A player begins playing a basic wagering game by making a wager via the value input device 918. The player can initiate play by using the player input device's buttons or touch screen 928. The basic game can include arranging a plurality of symbols along a payline 932, which indicates one or more outcomes of the basic game. Such outcomes can be randomly selected in response to player input. At least one of the outcomes, which can include any variation or combination of symbols, can trigger a bonus game.

In some embodiments, the wagering game machine 900 can also include an information reader 952, which can include a card reader, ticket reader, bar code scanner, RFID transceiver, or computer readable storage medium interface. In some embodiments, the information reader 952 can be used to award complimentary services, restore game assets, track player habits, etc.

In some embodiments, the wagering game machine 900 can include one or more of the components described above (e.g., an account manager).

General

In this detailed description, reference is made to specific examples by way of drawings and illustrations. These examples are described in sufficient detail to enable those skilled in the art to practice the inventive subject matter, and serve to illustrate how the inventive subject matter can be applied to various purposes or embodiments. Other embodiments are included within the inventive subject matter, as logical, mechanical, electrical, and other changes can be made to the example embodiments described herein. Features or limitations of various embodiments described herein, however essential to the example embodiments in which they are incorporated, do not limit the inventive subject matter as a whole, and any reference to the invention, its elements, operation, and application are not limiting as a whole, but serve only to define these example embodiments. This detailed description does not, therefore, limit embodiments of the invention, which are defined only by the appended claims.

Each of the embodiments described herein are contemplated as falling within the inventive subject matter, which is set forth in the following claims.

The invention claimed is:

1. A wagering game account server comprising:

a player account base configured to store a plurality of player casino accounts, the player casino accounts including funds;

a request processor electronically coupled to the player account base, the request processor configured to receive a request to electronically transfer funds from one of the player casino accounts to a wagering game machine, wherein the one of the player casino accounts is associated with a player, the request originating at a mobile phone, and the funds being for use in playing wagering games on the wagering game machine; and a transaction processor electronically coupled to the player account base and the request processor, the transaction processor configured to electronically transmit the funds to the wagering game machine and update the player account base to indicate a debit on the one of the player casino accounts, wherein the transaction processor is configured to electronically transmits the funds to the wagering game machine before the player is physically present at the wagering game machine.

2. The wagering game account server of claim 1, wherein the request to electronically transfer funds is included in a short message service (SMS) message.

3. The wagering game account server of claim 1, wherein the request processor is further configured to receive a request to electronically transfer funds from the mobile phone into the one of the player casino accounts;

the transaction processor is further configured to update the player account base to indicate a credit based on the transfer of funds from the mobile phone.

4. The wagering game account server of claim 1, wherein the transaction processor is further configured to determine that the one player casino accounts does not include the funds and to procure the funds from a secondary funding source.

5. The wagering game account server of claim 1, wherein the request to electronically transfer funds is included in a message in a protocol that is not native to the mobile phone.

6. A wagering game account server comprising:

means for receiving, from a mobile phone, a request to transfer funds from a financial institution account to a player casino account, wherein the player casino account is associated with a player;

means for requesting and receiving the funds from the financial institution account;

means for delivering the funds into the player casino account;

means for transferring at least some of the funds into a game session account available on one or more wagering game machines before the player is physically present at the wagering game machine, wherein the game session account provides the funds for use in wagering games; and means for notifying the mobile phone about one or more account transactions.

7. The wagering game account server of claim 6, wherein the transferring occurs before a player associated with the player casino account has signed-onto the wagering game machine.

8. The wagering game account server of claim 6 further comprising:

means for transferring at least some of the funds from the player casino account to the mobile phone.

9. A computerized method comprising:

storing a plurality of player casino accounts, the player casino accounts including funds;

receiving a request to electronically transfer funds from one of the player casino accounts for a player to a wagering game machine, the request originating at a mobile phone, and the funds being for use in playing wagering games on the wagering game machine;

electronically transmitting the funds to the wagering game machine before the player is physically present at the wagering game machine; and updating the player account base to indicate a debit on the one of the player casino accounts.

10. The computerized method of claim 9, wherein the request to electronically transfer funds is included in a short message service (SMS) message.

11. The computerized method of claim 9, further comprising:

receiving a request to electronically transfer funds from the mobile phone into the one of the player casino accounts; and updating the player account base to indicate a credit based on the transfer of funds from the mobile phone.

12. The computerized method of claim 9, further comprising:

determining that the one player casino accounts does not include the funds; and procuring the funds from a secondary funding source.

13. The computerized method of claim 9, wherein the request to electronically transfer funds is included in a message in a protocol that is not native to the mobile phone.

14. One or more machine-readable storage media including instructions which, when executed by one or more processors, cause the one or more processors to perform operations comprising:

store a plurality of player casino accounts, the player casino accounts including funds;

receive a request to electronically transfer funds from one of the player casino accounts for a player to a wagering game machine, the request originating at a mobile phone, and the funds being for use in playing wagering games on the wagering game machine;

electronically transmit the funds to the wagering game machine before the player is physically present at the wagering game machine; and update the player account base to indicate a debit on the one of the player casino accounts.

15. The one or more machine-readable storage media of claim 14, wherein the request to electronically transfer funds is included in a short message service (SMS) message.

16. The one or more machine-readable storage media of claim 14, wherein the operations comprise:

receive a request to electronically transfer funds from the mobile phone into the one of the player casino accounts; and update the player account base to indicate a credit based on the transfer of funds from the mobile phone.

17. The one or more machine-readable storage media of claim 14, wherein the operations comprise:

determining that the one player casino accounts does not include the funds; and procuring the funds from a secondary funding source.

18. The one or more machine-readable storage media of claim 14, wherein the request to electronically transfer funds is included in a message in a protocol that is not native to the mobile phone.

* * * * *